United States Patent [19]

Martin et al.

[11] 4,321,739

[45] Mar. 30, 1982

[54] METHOD AND APPARATUS FOR ASSEMBLING HEAT EXCHANGERS

[75] Inventors: William A. Martin, North Tonawanda, N.Y.; Harold H. Harper, Holiday Island, Ark.

[73] Assignee: General Motors Corporation, Detroit, Mich.

[21] Appl. No.: 158,608

[22] Filed: Jun. 11, 1980

[51] Int. Cl.[3] ..... B23P 15/26

[52] U.S. Cl. ..... 29/157.3 A; 29/726; 29/157.3 R; 29/157.3 B

[58] Field of Search ..... 29/726, 727, 157.3 A, 29/157.3 R, 157.3 B, 157.3 C; 113/1 C, 118 V, 118 R, 118 A, 118 B

[56] References Cited

U.S. PATENT DOCUMENTS

| | | | |
|---|---|---|---|
| 2,252,210 | 8/1941 | Seemiller | 113/118 |
| 3,726,466 | 4/1973 | Vedder | 29/726 |
| 4,228,573 | 10/1980 | Barnard | 113/1 C |

*Primary Examiner*—Francis S. Husar
*Assistant Examiner*—V. K. Rising
*Attorney, Agent, or Firm*—R. L. Phillips

[57] ABSTRACT

Method and apparatus are disclosed for automatically assembling a heat exchanger core assembly comprised of tubes and centers arranged in alternate rows and a pair of reinforcement members arranged on opposite sides of the rows adjacent the outermost centers.

2 Claims, 12 Drawing Figures

METHOD AND APPARATUS FOR ASSEMBLING HEAT EXCHANGERS

This invention relates to method and apparatus for assembling heat exchangers and more particularly to method and apparatus for rapidly assembling heat exchanger core assemblies comprised of tubes, centers and reinforcements.

Typically, the assembly line production of heat exchangers, such as engine radiators, utilizes both hand operations and fixtures to assemble the tubes, centers (corrugated fins) and reinforcements. For example, there is typically provided a work fixture on to which the tubes and reinforcements are first manually loaded. Then the centers are manually loaded between adjacent tubes and reinforcements whereafter this core assembly is removed from the fixture while held between a clamp and transferred to a header machine. At the latter, headers are applied to the ends of the tubes. Finally, tanks are placed against the headers and then the complete assembly is soldered or brazed together. Alternatively, the tanks may be gasketed and the headers clinched thereto following soldering or brazing of just the headers and core assembly.

The present invention is directed to automating the assembly of the tubes, centers and reinforcements prior to the fitting of the headers and in a manner which minimizes the amount of floor space required for the line as well as the time at and between work stations. This is accomplished by continuously conveying two parallel arranged series of reinforcement holders and tube holders past consecutively located work stations, with the tube holders arranged between pairs of reinforcement holders in each series and corresponding in number to the rows of tubes in the desired core assembly. A pair of reinforcements are fed at one of the work stations into the passing pairs of reinforcement holders so that they are supported at their ends thereon with their backsides facing away from each other. Then at a subsequent work station a tube is fed into each of the passing tube holders so that they are supported at their ends thereon in the desired spaced relationship to each other and to the backsides of the reinforcements between which they are thus held. In the case of multilayer tube cores, the passing tube holders are thereafter conditioned for reception of one or more other tubes in the desired relationship to the tube(s) previously loaded thereon. Then at one or more subsequent feed points, a tube is fed into each of the passing tube holders so that they are supported at their ends thereon in the desired spaced relationship to each other and to the previously loaded tube(s). In the case of a single layer tube core, the subsequent tube feeds are simply omitted. While the tube and reinforcement loading is occuring, a complete set of fins is loaded in a grate which is then transported by a separate conveyor to a position overhead the moving tube and reinforcement holder conveyor. The loaded grate is synchronized with the loaded tube and reinforcement holders and the fins are then pushed from the grate into the spaces between the passing tubes and reinforcement members to thereby form a complete core assembly. Finally, each complete core assembly is gathered intact from its holders for delivery to a header machine.

These and other objects and advantages and features of the present invention will be more apparent from the following description and drawings in which.

Figure 1:
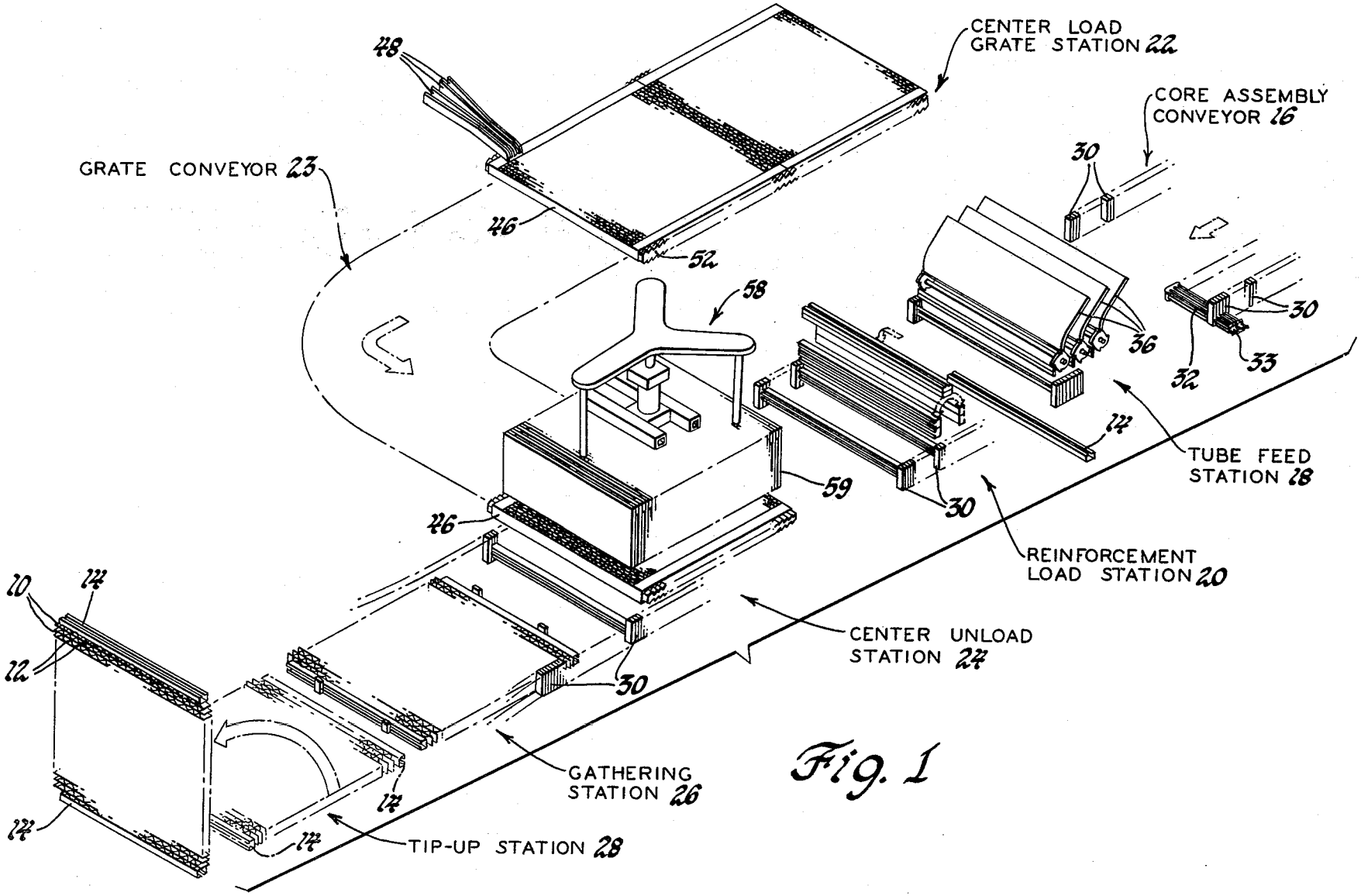
FIG. 1 is a diagrammatic view in perspective of the preferred arrangement of the apparatus for assembling heat exchanger core assemblies according to the present invention.

There is shown in FIG. 1 an assembly line for automatically assembling the core of a heat exchanger, such as an engine radiator, comprised of a plurality of tubes 10, a plurality of centers (corrugated fins) 12 and a pair of reinforcements 14. The assembly line comprises a core assembly conveyor 16, a tube feed station 18, a reinforcement load station 20, a center load grate station 22, a grate conveyor 23, a center unload station 24, a gathering station 26 and a tip-up station 28.

Figure 2:
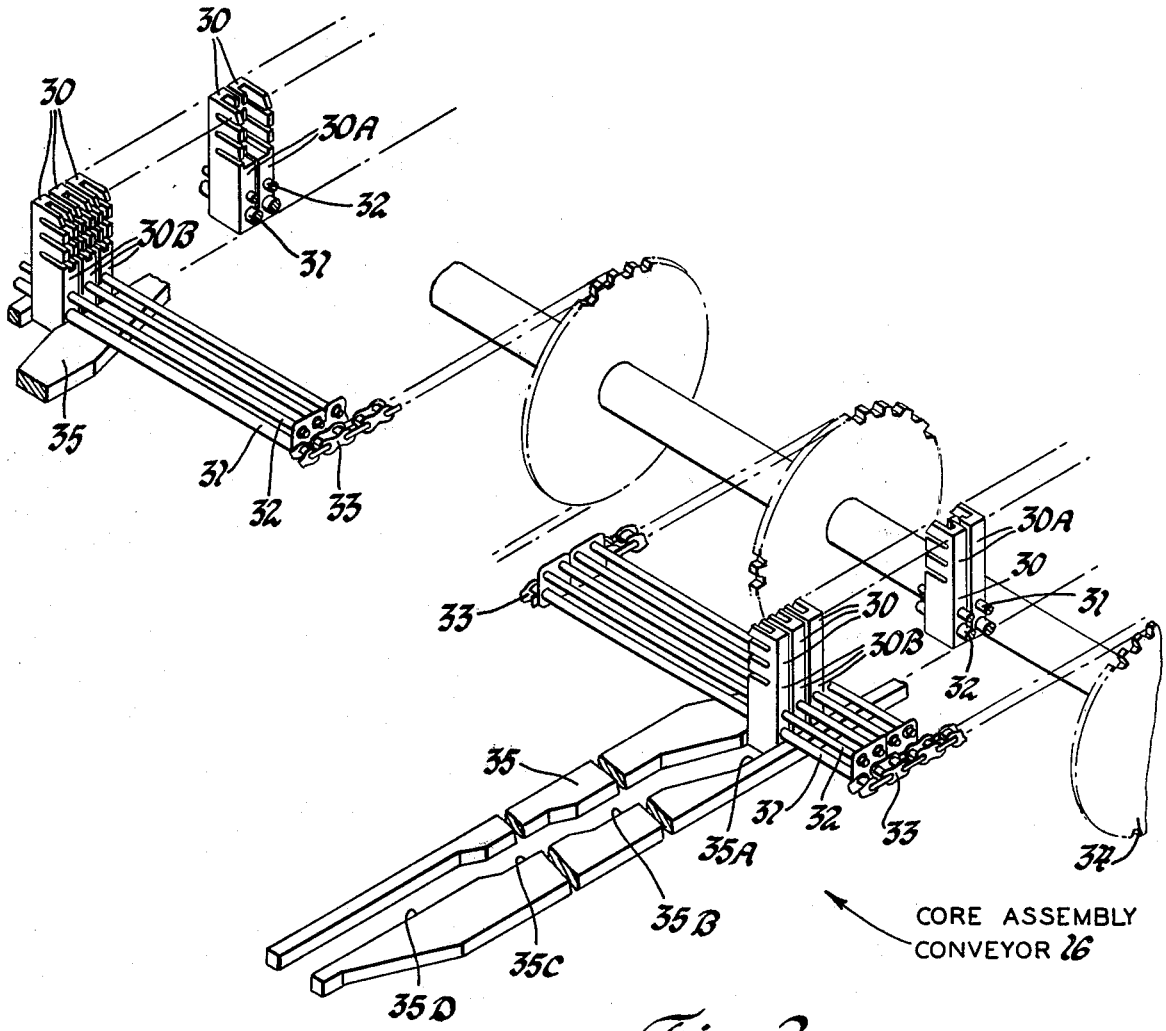
FIG. 2 is an enlarged diagrammatic view in perspective of part of the conveyor in FIG. 1.

As best shown in FIG. 2, the core assembly conveyor 16 is comprised of two parallel arranged endless series of blocks 30 on opposite sides thereof which are separately mounted on rods 31 and 32 that are mounted in turn on endless chains 33. The conveyor is powered by a drive unit 34 to run continuously and the aligned blocks 30 on the opposite sides of the conveyor 16 are cammed toward each other (inward) and apart (outward) on their rods by cam tracks 35 extending each side of the conveyor so as to contain or release the radiator tubes and reinforcements as will be described in more detail later.

Figure 3:
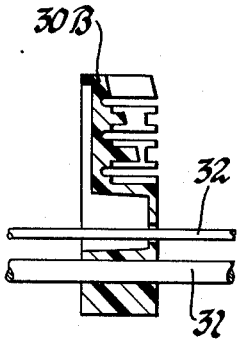
FIGS. 3, 4 and 5 are cross-sectional views of one side of the conveyor in FIG. 2 showing the sequential side movement of the tube and reinforcement holders thereof.
Figure 4:
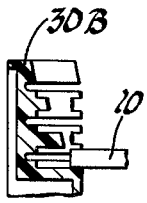
Figure 5:
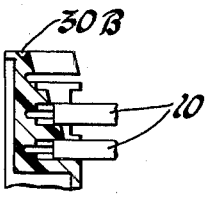

The blocks 30 are similar except that certain of the blocks 30A are shaped to serve as reinforcement holders and are arranged in pairs in each series while the other blocks 30B are shaped to serve as tube holders and are arranged between the pairs of reinforcement holders 30A in each series and correspond in number to the number of rows of tubes desired in the core assembly. A sectional view of one of the tube holder blocks 30B is shown in three of the four positions to which it is cammed by its track 35 in FIGS. 3, 4 and 5. In FIG. 3, one of the tube holder blocks 30B is shown in its out or release position as provided by track section 35A whereas in FIG. 4, the block is shown cammed slightly inward where it is positioned by track section 35B to receive a first tube 10 and then in FIG. 5 the block is shown cammed further inward to track section 35C so as to be located under and receive a second tube as shown. Furthermore, an additional inward camming of the block is provided by track section 35D so as to contain the two previous tubes and then receive a third tube if required. Using this basic arrangement, the various track sections 35A-D are located relative to the various work stations so as to position the reinforcement and tube holders 30A and 30B according to the operation(s) being performed thereat as will now be described in detail.

Figure 6:
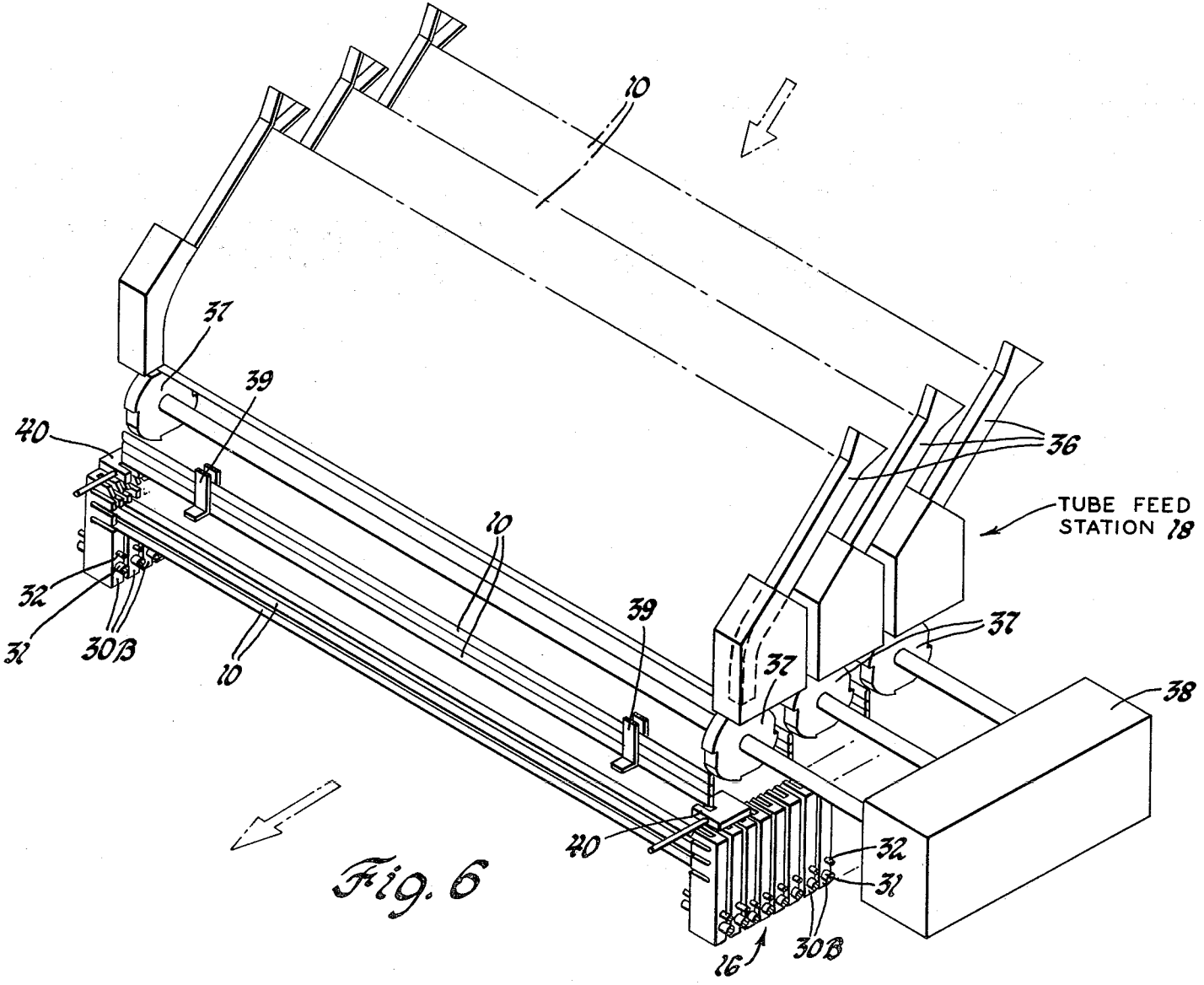
FIG. 6 is an enlarged diagrammatic view in perspective of the tube feed station in FIG. 1.

The tubes 10 are fed into the tube holder blocks 30B at the tube feed station 18 which is located as the first work station and at an elevation immediately above the core assembly conveyor 16. At the tube feed station 18 and as best shown in FIG. 6, the tubes 10 which have a rounded rectangular cross-section are fed into chutes 36 whose number is determined by the number of tube layers desired in the core assembly. In the embodiment shown, there are three tube chutes provided and thus, there is a capability for assembling three layers of tubes to match the capacity of the tube holder blocks 30B. The tube chutes 36 stack the tubes immediately above the core assembly conveyor 16 and guide the tubes on to two orienting discs 37 which are located beneath the opposite ends of the respective chutes and are sequentially indexed by an indexing mechanism 38. The orienting discs 37 are notched as shown to receive the tubes and the tubes are rotated 90° thereby to be stacked between stationary uprights 39 from which they are then shuttled by a shuttle mechanism 40 so as to be deposited one tube at a time into the tube holder blocks 30B as they are being advanced underneath thereby by the core assembly conveyor 16. If two tubes are required in each row, two of the shuttle mechanisms 40 are operated in sequence as the tube holder blocks 30B move thereunder. If three tubes are required, then all three shuttles are operated in sequence as the tube holder blocks pass underneath.

Figure 7:
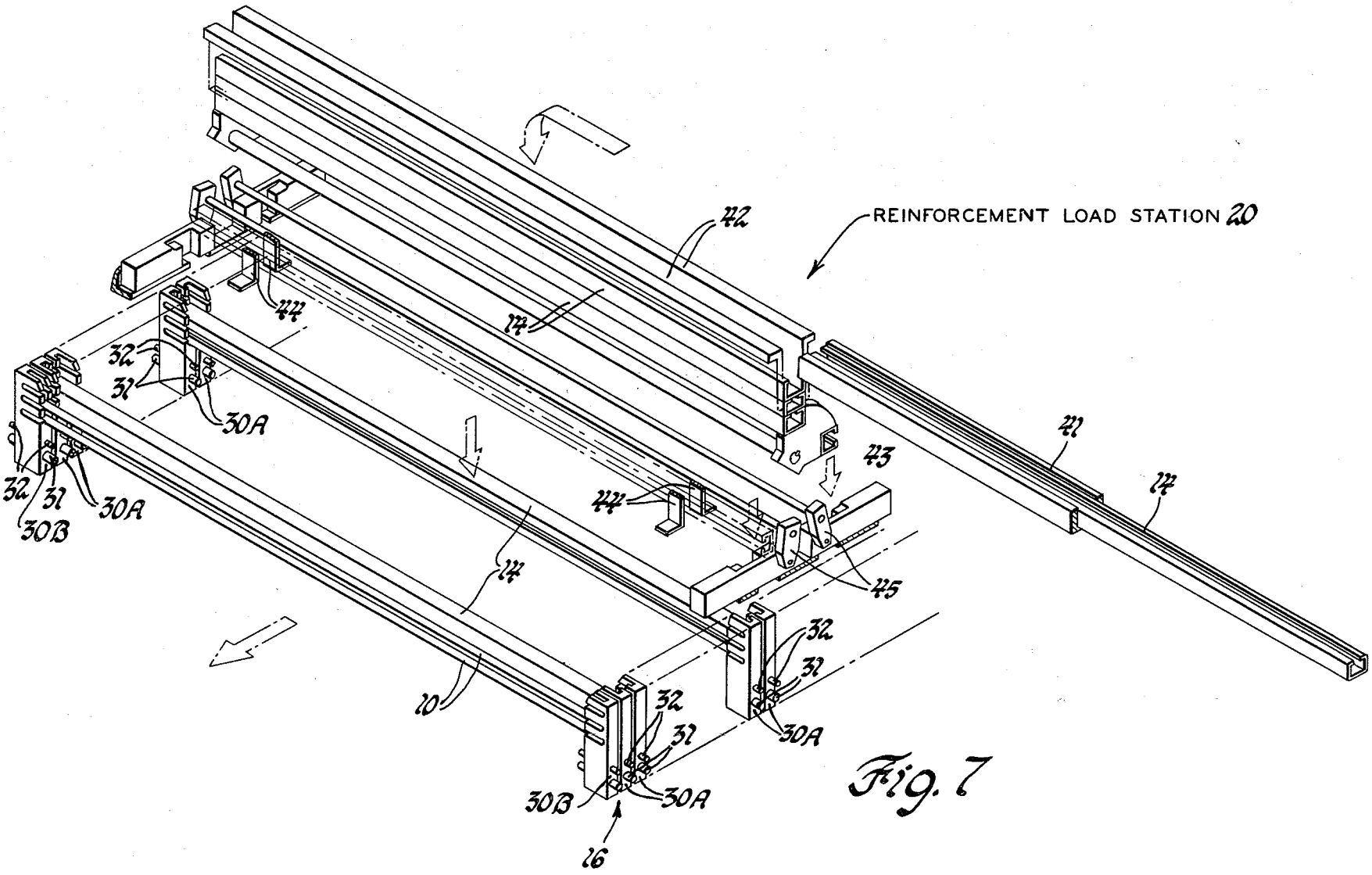
FIG. 7 is an enlarged diagrammatic view in perspective of the reinforcement load station in FIG. 1.

The core assembly conveyor 16 moves the thus loaded tube holder blocks 30B along with the still empty reinforcement holder blocks 30A to the reinforcement load station 20. At this station and as best shown in FIG. 7, the reinforcements 14 which have a C-shaped cross-section are longitudinally fed through a stationary guide 41 into a chute 42 which stacks them above an orienting device 43 located immediately above the conveyor 16. The orienting device 43 rotates the reinforcements 90° to be either a core starting reinforcement or alternatively 90° in the opposite direction to be a core finishing reinforcement. The reinforcements are thus located in two stacks of opposite orientation where they are retained between stationary uprights 44 and from which they are then dropped by a shuttle mechanism 45 into the proper reinforcement holder blocks 30A.

Figure 8:
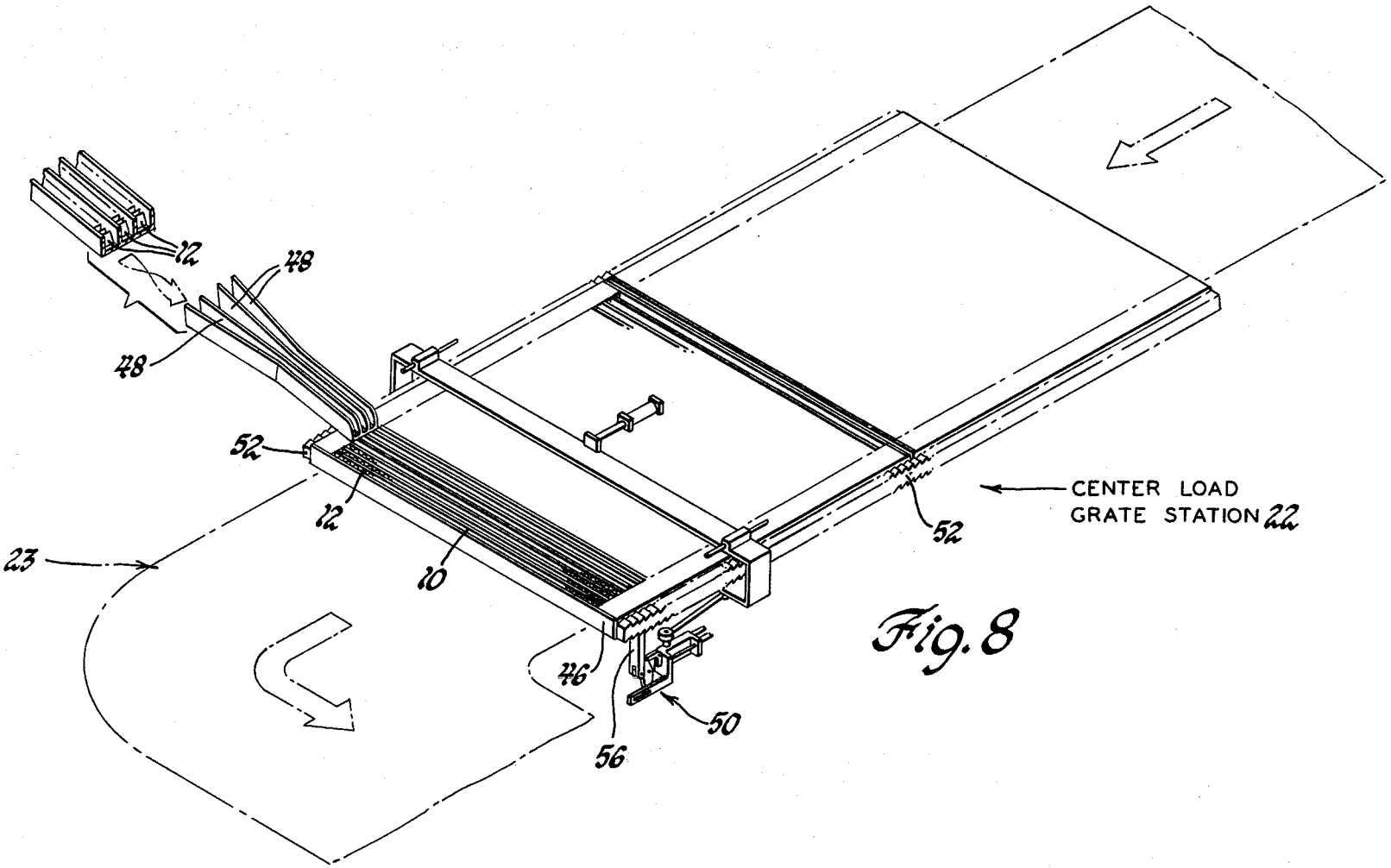
FIG. 8 is an enlarged diagrammatic view in perspective of the center load grate station in FIG. 1.
Figure 9:
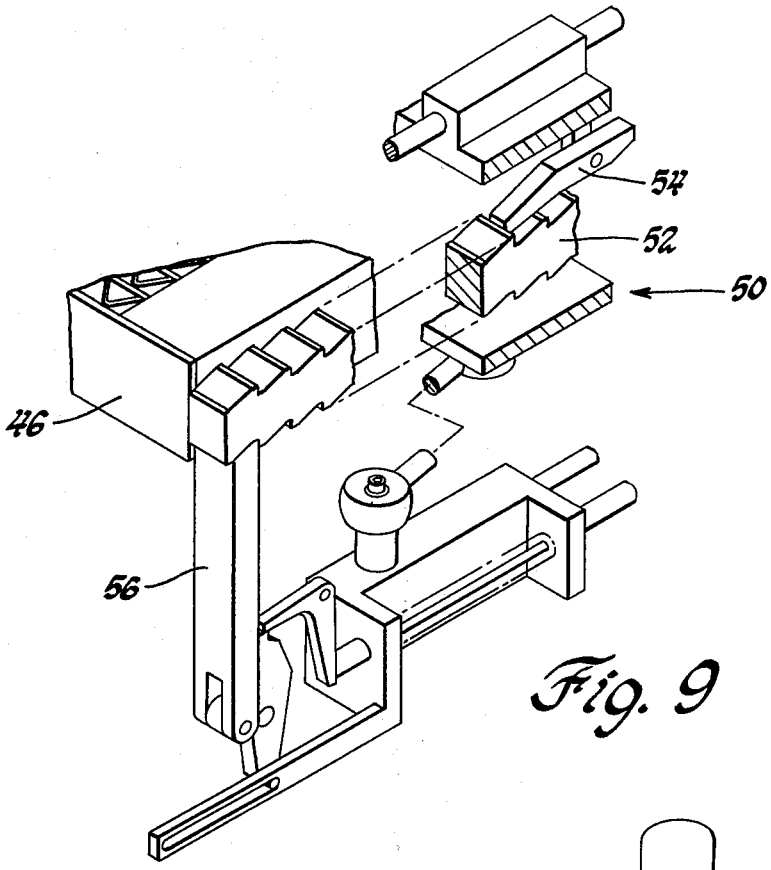
FIG. 9 is an enlarged diagrammatic view in perspective of part of the advancing mechanism of the center load grate station in FIG. 8.

The core assembly conveyor 16 as it continues to move, then advances the thus loaded tubes and reinforcements to the center unload station 24. In the meantime, at the center load grate station 22 and as best shown in FIG. 8, there is being delivered on the separate grate conveyor 23 plurality of grates 46 which each have slots correspond in number and size to the spaces between the tubes and reinforcements of the core assembly. At the center load grate station, there is provided a plurality of chutes 48, such as the three shown, located to one side of the grate conveyor 23. As the grates 46 approach the chutes 48 their advancement is controlled by an indexing mechanism 50. The indexing mechanism 50 is of the pawl and ratchet type and as best shown in FIG. 9 comprises a double-sided rack 52 formed on each side of the grate 46 which is sequentially engaged by linkage actuated pawls 54 and 56 so as to advance, hold and release the grate and then repeat this operation on each following grate. The centers 12 which may be fed directly from their forming machine are cycled to slide down the chutes 48 into the then passing grate when three empty slots in the grate come into alignment therewith. The grate is then indexed three more slots and three more fins are fed into the grate and this is repeated until the grate is full. Then the thus loaded grate 46 is released by the indexing mechanism 50 and transported by the conveyor 23 to the center unload station 24 at an elevation overhead the core assembly conveyor 16.

Figure 10:
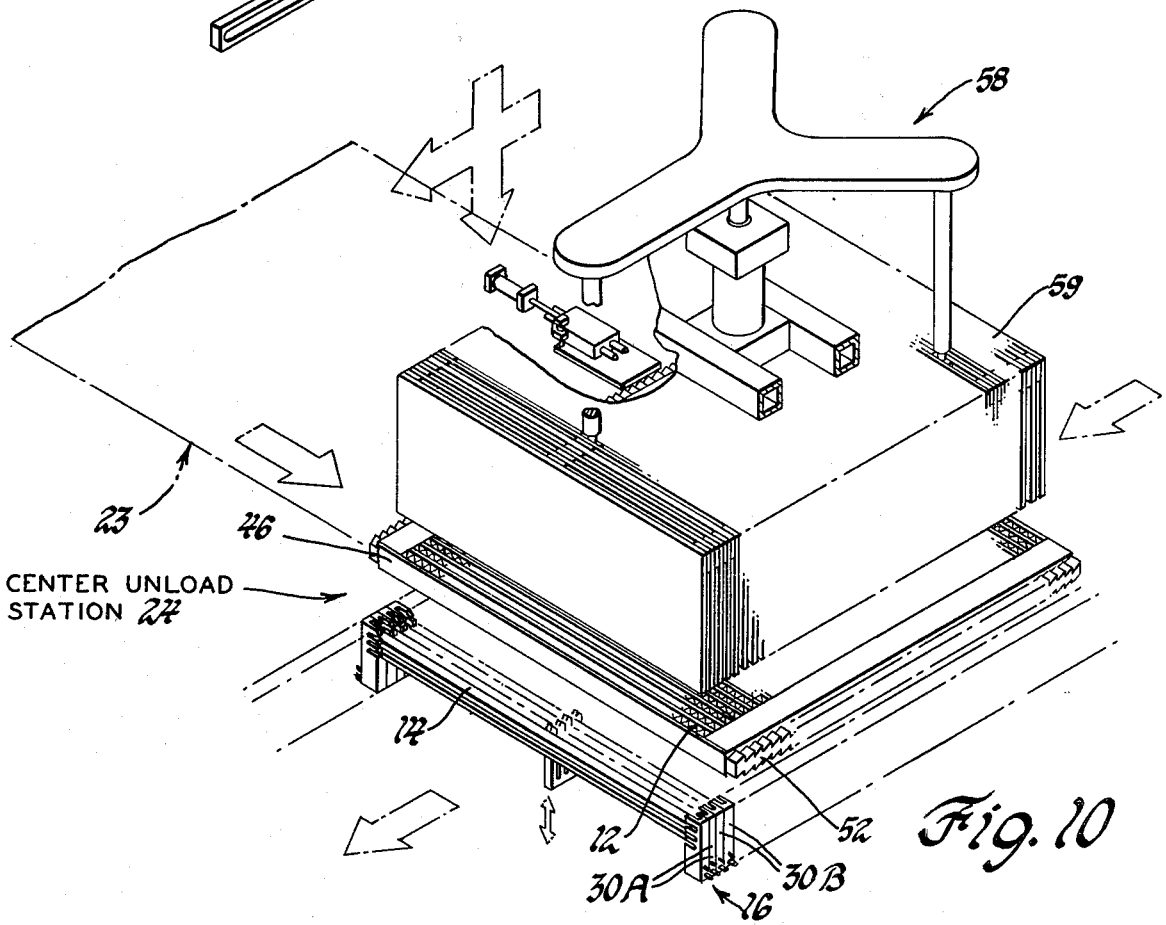
FIG. 10 is an enlarged diagrammatic view in perspective of the center unload station in FIG. 1.

At the center unload station 24 and as best shown in FIG. 10, the previously loaded reinforcements and tubes on the core assembly conveyor 16 are moved under the loaded grate 46 while the latter had been moved under a center pusher assembly 58. As the reinforcements 14 and tubes 10 move through the center unload station 24, the grate 46 with the loaded centers 12 and the center pusher assembly 58 synchronize with them. The grate 46 then indexes forward allowing the centers to be released therefrom by alignment with the spaces between the loaded tubes and reinforcements. A pusher grid 59 of the center pusher assembly 58 then comes down and pushes the centers 12 into the proper spaces between the tubes 10 and reinforcements 14. The center pusher grid 59 then retracts and the thus completed core assembly comprised of the reinforcements, tubes and centers is then moved by the core assembly conveyor 16 to the gathering station 26. Meantime, the unloaded grate 46 is returned to the center load grate station 22 by the conveyor 23 to be reloaded.

Figure 11:
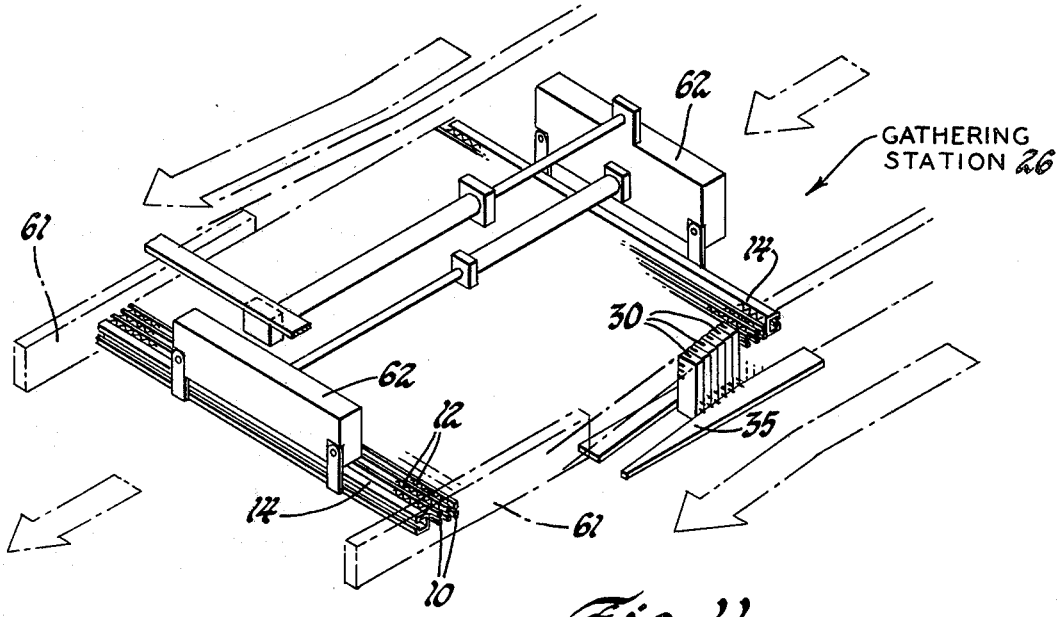
FIG. 11 is an enlarged diagrammatic view in perspective of the gathering station in FIG. 1.

At the gathering station 26 and as best shown in FIG. 11, the reinforcement and tube holders 30A and 30B are cammed by their cam tracks 35 to move outward from the respective reinforcements and and tubes so that the core assembly is free of the core assembly conveyor 16 and is then guided and contained by guide rails 61. As the trailing reinforcement which is the last part of the core is released by the core assembly conveyor 16, a pair of gathering stops 62 operate to engage the two reinforcements 14 which sandwich the fins and tubes and clamp the core assembly therebetween.

Figure 12:
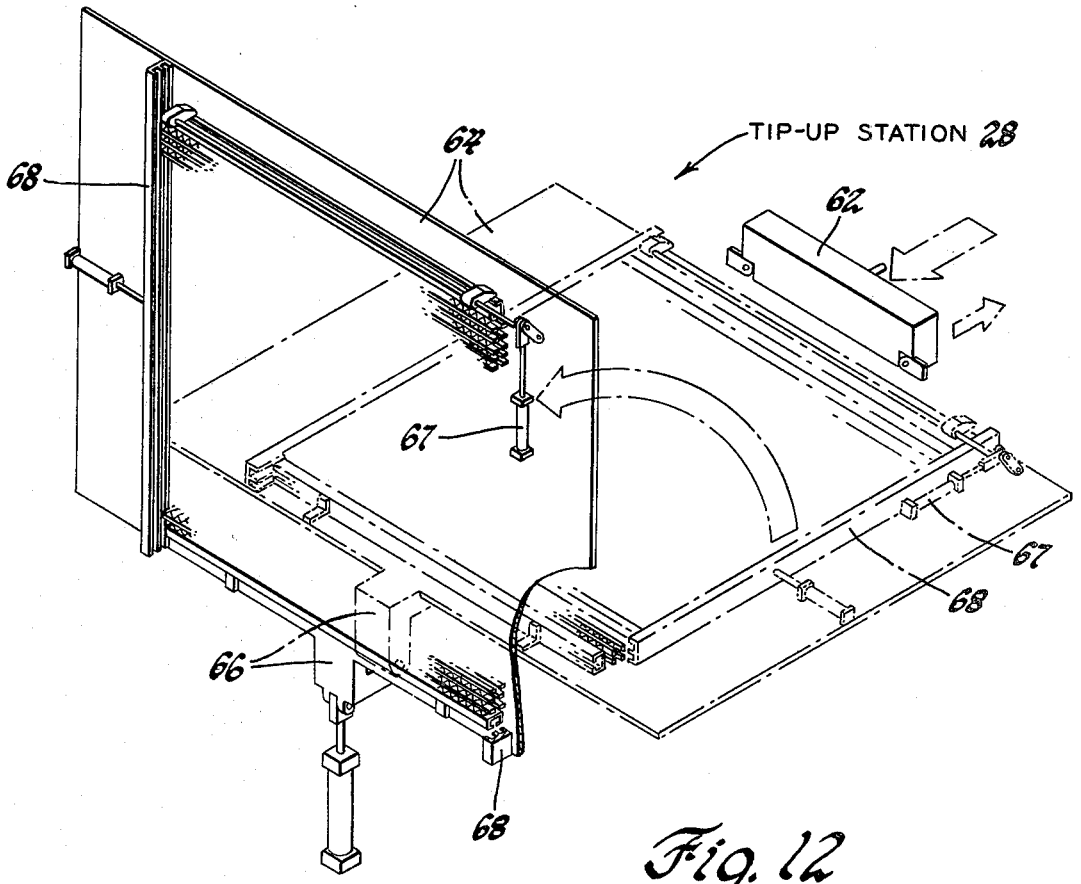
FIG. 12 is an enlarged diagrammatic view in perspective of the tip-up station in FIG. 1.

The gathering stops 62 then advance the core assembly to the tip-up station 28 which is best shown in FIG. 12. The core assembly is then released at this station by the gathering stops 62 and thereafter grasped on a pivotal table 64 by clamps 66,67 and between rail extensions 68. The core assembly is then rotated 90° by the table 64 to a vertical position as shown in solid line. While held in this position, the rail extensions 68 are retracted so that the core assembly can be grasped and removed from the tip-up station and transferred to a header machine (not shown).

This completes the automatic assembly of the tubes, fins and reinforcements of a core assembly. And it will be understood that with the core assembly conveyor 16 moving continuously, such core assemblies can be automatically assembled one after the other without requiring any removable core assembly pallet fixtures on the main assembly line. On the other hand, the grates for fin loading do not become a part of the main conveyor but are recycled by separate conveyor to establish the fin loading as described. Furthermore, having shown and described the basic mechanisms and their operations at the various work stations, it will be understood by those skilled in the art that the details of such apparatus may take various forms and therefore, further detailed disclosure thereof is unnecessary. It will also be understood that the above described preferred embodiment is intended to be illustrative of the invention which may be modified within the scope of the appended claims.

The embodiments of the invention in which an exclusive property or privilege is claimed are defined as follows:

1. A method of assembling a heat exchanger core assembly comprised of tubes and corrugated fins arranged in alternate rows and a pair of reinforcement members arranged on opposite sides of the rows adjacent the outermost fins, said method comprising:

(a) conveying two parallel arranged series of reinforcement member holders and tube holders past consecutively located work stations and with the reinforcement member holders arranged in pairs in each series, and with the tube holders arranged between the pairs of reinforcement member holders in each series and corresponding in number to the number of rows of tubes in the core assembly, (b) feeding a pair of reinforcement members at one of the work stations into the passing pairs of reinforcement member holders so that they are supported at their ends thereon with their backsides facing away from each other, (c) feeding a tube at a subsequent work station into each of the passing tube holders so that they are supported at their ends thereon in the desired spaced relationship to each other and to the backsides of the reinforcement members between which they are thus held;

(d) loading a complete set of fins in a grate.

(e) feeding the set of fins from the grate at a subsequent work station into the spaces between the passing tubes and reinforcement members to thereby form a complete core assembly, and (f) unloading each complete core assembly from its holders while retaining it intact at a subsequent work station.

2. A method of assembling a heat exchanger core assembly comprised of tubes and corrugated fins arranged in alternate rows and a pair of reinforcement members arranged on opposite sides of the rows adjacent the outermost fins and wherein the tubes have at least two layers in each row thereof, said method comprising:

(a) conveying two parallel arranged series of reinforcement member holders and tube holders past consecutively located work stations and with the reinforcement member holders arranged in pairs in each series, and with the tube holders arranged between the pairs of reinforcement member holders in each series and corresponding in number to the number of rows of tubes in the core assembly, (b) feeding a pair of reinforcement members at one of the work stations into the passing pairs of reinforcement member holders so that they are supported at their ends thereon with their backsides facing away from each other, (c) feeding a tube at a subsequent work station into each of the passing tube holders so that they are supported at their ends thereon in the desired spaced relationship to each other and to the backsides of the reinforcement members between which they are thus held;

(d) conditioning the passing tube holders for reception of another tube in the desired relationship to the tube previously loaded thereon, (e) feeding a tube at a subsequent work station into each of the passing tube holders so that they are supported at their ends thereon in the desired spaced relationship to each other and to the previously loaded tubes and the backsides of the reinforcement members between which they are thus held, (f) loading a complete set of fins in a grate, (g) feeding the set of fins from the grate at a subsequent work station into the spaces between the passing tubes and reinforcement members to thereby form a complete core assembly, and (h) unloading each complete core assembly from its holders while retaining it intact at a subsequent work station.

* * * * *